US010920555B2

(12) United States Patent
Procita et al.

(10) Patent No.: US 10,920,555 B2
(45) Date of Patent: Feb. 16, 2021

(54) FLUID EXCHANGE DEVICES AND RELATED CONTROLS, SYSTEMS, AND METHODS

(71) Applicant: Flowserve Management Company, Irving, TX (US)

(72) Inventors: Zach Procita, Warrington, PA (US); Jason Bandi, Irving, TX (US); Mark O'Sullivan, Phillipsburg, NJ (US); Andreas Dreiss, Hamburg (DE); Scott Judge, Bethlehem, PA (US); Christopher Shages, Bethlehem, PA (US); Tom Knochenhauer, Escondido, CA (US)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 16/678,720

(22) Filed: Nov. 8, 2019

(65) Prior Publication Data

US 2020/0149380 A1 May 14, 2020

Related U.S. Application Data

(60) Provisional application No. 62/758,327, filed on Nov. 9, 2018.

(51) Int. Cl.
*E21B 43/26* (2006.01)
*F24F 13/00* (2006.01)

(52) U.S. Cl.
CPC ..... *E21B 43/26* (2013.01); *F24F 13/00* (2013.01)

(58) Field of Classification Search
CPC ..... E21B 43/26; E21B 43/2607; F24F 13/00
See application file for complete search history.

(56) References Cited

U.S. PATENT DOCUMENTS

| | | | |
|---|---|---|---|
| 1,577,242 | A | 3/1926 | Andersen |
| 1,647,189 | A | 11/1927 | Philip et al. |
| 1,647,734 | A | 11/1927 | Kelly |
| 1,769,672 | A | 7/1930 | Blair |
| 2,365,046 | A | 12/1944 | Bottomley |
| 2,600,836 | A | 6/1952 | Boyd |
| 2,615,465 | A | 10/1952 | Woodward |
| 3,089,504 | A | 5/1963 | Crawford |

(Continued)

FOREIGN PATENT DOCUMENTS

| | | | |
|---|---|---|---|
| CN | 101705930 | B | 2/2012 |
| CN | 102421513 | A | 4/2012 |

(Continued)

OTHER PUBLICATIONS

PCT Patent Application No. PCT/US2019/060564, International Search Report dated Feb. 27, 2020, 2 pp.

(Continued)

*Primary Examiner* — James G Sayre
(74) *Attorney, Agent, or Firm* — Phillips Winchester

(57) ABSTRACT

Pressure exchange devices and related systems may include a valve device configured to selectively place a fluid at a first higher pressure in communication with another fluid at a lower pressure in order to pressurize the another fluid to a second higher pressure. Methods of exchanging pressure between at least two fluid streams may include a pressure exchanger having two low pressure inlets.

20 Claims, 4 Drawing Sheets

(56) References Cited

U.S. PATENT DOCUMENTS 3,202,108 A * 8/1965 Fly ..... F04B 47/00 417/74
3,223,173 A 12/1965 Paul, Jr.
3,347,554 A 10/1967 Jagger et al.
3,570,510 A 3/1971 Tsutsumi
3,583,606 A 6/1971 Ewald
3,595,265 A 7/1971 Cryder et al.
3,612,361 A 10/1971 Ewald et al.
3,661,167 A 5/1972 Hussey
3,661,400 A 5/1972 Weinand
3,675,825 A 7/1972 Morane
3,675,935 A 7/1972 Ludwig et al.
3,741,243 A 6/1973 Deibler et al.
3,749,291 A 7/1973 Prussin et al.
3,756,273 A 9/1973 Hengesbach
3,776,278 A 12/1973 Allen
4,024,891 A 5/1977 Engel et al.
4,123,332 A 10/1978 Rotter
4,133,346 A 1/1979 Smith et al.
4,134,454 A 1/1979 Taylor
4,176,063 A 11/1979 Tyler
4,234,010 A 11/1980 Jenkins et al.
4,236,547 A 12/1980 Harasewych
4,244,555 A 1/1981 Maggioni et al.
4,308,103 A 12/1981 Rotter
4,321,021 A 3/1982 Pauliukonis
4,350,176 A 9/1982 Lace
4,412,632 A 11/1983 Berger et al.
4,424,917 A 1/1984 Berger et al.
4,479,356 A 10/1984 Gill
4,510,963 A 4/1985 Presley et al.
4,518,006 A 5/1985 Hoffmann et al.
4,570,853 A 2/1986 Schmied
4,579,511 A 4/1986 Burns
4,586,692 A 5/1986 Stephens
4,627,461 A 12/1986 Gordon
4,726,530 A 2/1988 Miller et al.
4,768,542 A 9/1988 Morris
4,834,193 A 5/1989 Leitko et al.
4,999,872 A 3/1991 Jentsch
5,033,557 A 7/1991 Askew
5,070,817 A 12/1991 Momont
5,172,918 A 12/1992 Pecht et al.
5,232,013 A 8/1993 Morris
5,234,031 A 8/1993 Pickett et al.
5,240,036 A 8/1993 Morris
5,299,859 A 4/1994 Tackett et al.
5,300,041 A 4/1994 Haber et al.
5,357,995 A 10/1994 King et al.
5,797,429 A 8/1998 Shumway
5,951,169 A 9/1999 Oklejas et al.
5,992,289 A 11/1999 George et al.
6,036,435 A 3/2000 Oklejas
6,126,418 A 10/2000 Sinnl
6,293,245 B1 9/2001 Bock
RE37,921 E 12/2002 Martin et al.
6,516,897 B2 2/2003 Thompson
6,540,487 B2 4/2003 Polizos et al.
6,607,368 B1 8/2003 Ross et al.
6,647,938 B2 11/2003 Gaessler et al.
6,659,731 B1 12/2003 Hauge
7,128,084 B2 10/2006 Long et al.
7,201,557 B2 4/2007 Stover
7,306,437 B2 12/2007 Hauge
7,474,013 B2 1/2009 Greenspan et al.
7,670,482 B2 3/2010 Wietham
7,871,522 B2 1/2011 Stover et al.
RE42,432 E 6/2011 Stover
7,997,853 B2 8/2011 Pique et al.
8,075,281 B2 12/2011 Martin et al.
8,297,303 B2 10/2012 Desantis et al.
8,360,250 B2 1/2013 Nguyen et al.
8,465,000 B2 6/2013 Bartell et al.
8,579,603 B2 11/2013 Oklejas et al.
8,603,218 B2 12/2013 Montie et al.
8,622,714 B2 1/2014 Andrews
9,108,162 B2 8/2015 Takahashi et al.
9,163,737 B2 10/2015 Andersson
9,328,743 B2 5/2016 Hirosawa et al.
9,435,354 B2 9/2016 Lehner et al.
9,440,895 B2 9/2016 Arluck et al.
9,500,394 B2 11/2016 Manzo
9,523,261 B2 12/2016 Flores et al.
9,546,671 B2 1/2017 Hirosawa et al.
9,556,736 B2 1/2017 Sigurdsson
9,587,752 B2 3/2017 Montague
9,604,889 B2 3/2017 Arluck et al.
9,611,948 B1 4/2017 Andersson
9,683,574 B2 6/2017 Winkler et al.
9,695,795 B2 7/2017 Martin et al.
9,739,128 B2 8/2017 Ghasripoor et al.
9,739,275 B2 8/2017 Robison et al.
9,759,054 B2 9/2017 Gay et al.
9,764,272 B2 9/2017 Martin et al.
9,835,018 B2 12/2017 Krish et al.
9,885,372 B2 2/2018 Arluck et al.
9,920,774 B2 3/2018 Ghasripoor et al.
9,945,210 B2 4/2018 Theodossiou
9,945,216 B2 4/2018 Ghasripoor et al.
9,970,281 B2 5/2018 Ghasripoor et al.
9,975,789 B2 5/2018 Ghasripoor et al.
9,976,573 B2 5/2018 Martin et al.
10,001,030 B2 6/2018 Krish et al.
10,006,524 B2 6/2018 Crump et al.
10,024,496 B2 7/2018 Hauge
10,030,372 B2 7/2018 Di Monte, Sr.
10,072,675 B2 9/2018 McLean et al.
10,119,379 B2 11/2018 Richter et al.
10,125,796 B2 11/2018 Hauge
10,138,907 B2 11/2018 Pinto et al.
10,167,710 B2 1/2019 Ghasripoor et al.
10,167,712 B2 1/2019 Ghasripoor et al.
2002/0025264 A1 2/2002 Polizos et al.
2004/0118462 A1 6/2004 Baumann
2005/0103386 A1 5/2005 Magda
2006/0145426 A1 7/2006 Schroeder et al.
2006/0196474 A1 9/2006 Magel
2006/0231577 A1 10/2006 Powling et al.
2007/0204916 A1 9/2007 Clayton et al.
2009/0057084 A1 3/2009 Mahawili
2009/0104046 A1 4/2009 Martin et al.
2009/0313737 A1 12/2009 Richard
2012/0024249 A1 2/2012 Fuhrmann et al.
2012/0067825 A1 3/2012 Pique et al.
2014/0026608 A1 1/2014 Manzo et al.
2014/0048143 A1 2/2014 Lehner et al.
2014/0284058 A1 9/2014 Watson et al.
2015/0130142 A1 5/2015 Zheng et al.
2015/0184540 A1 7/2015 Winkler et al.
2015/0292310 A1 10/2015 Ghasripoor et al.
2016/0032691 A1 2/2016 Richter et al.
2016/0032702 A1* 2/2016 Gay ..... E21B 43/16 137/14
2016/0039054 A1 2/2016 Ghasripoor et al.
2016/0062370 A1 3/2016 Gaines-Germain et al.
2016/0101307 A1 4/2016 Montague
2016/0102536 A1 4/2016 Knoeller
2016/0138649 A1 5/2016 Anderson et al.
2016/0146229 A1 5/2016 Martin et al.
2016/0153551 A1 6/2016 Schiele et al.
2016/0160849 A1 6/2016 Gains-Germain et al.
2016/0160881 A1 6/2016 Anderson et al.
2016/0160882 A1 6/2016 Morphew
2016/0160887 A1 6/2016 Anderson
2016/0160888 A1 6/2016 Morphew
2016/0160889 A1 6/2016 Hoffman et al.
2016/0160890 A1 6/2016 Anderson
2016/0160917 A1 6/2016 Deshpande
2016/0377096 A1 12/2016 Lehner et al.
2017/0108131 A1 4/2017 Andersson
2017/0130743 A1 5/2017 Anderson
2017/0191350 A1* 7/2017 Johns ..... E21B 43/26
2017/0254474 A1 9/2017 Sauer
2017/0306986 A1 10/2017 McLean et al.

(56) References Cited

U.S. PATENT DOCUMENTS

| | | | | |
|---|---|---|---|---|
| 2017/0306987 | A1 | 10/2017 | Theodossiou | |
| 2017/0350428 | A1 | 12/2017 | Martin et al. | |
| 2017/0370500 | A1 | 12/2017 | Haines et al. | |
| 2018/0030968 | A1* | 2/2018 | Verma | E21B 43/26 |
| 2018/0056211 | A1 | 3/2018 | Seabrook et al. | |
| 2018/0087364 | A1 | 3/2018 | Krish et al. | |
| 2018/0094648 | A1 | 4/2018 | Hoffman et al. | |
| 2018/0120197 | A1 | 5/2018 | Di Monte | |
| 2018/0195370 | A1 | 7/2018 | Theodossiou | |
| 2018/0209254 | A1* | 7/2018 | Ghasripoor | E21B 43/16 |
| 2018/0252239 | A1 | 9/2018 | Martin et al. | |
| 2018/0306672 | A1 | 10/2018 | Pattom et al. | |
| 2018/0347601 | A1 | 12/2018 | Hoffman et al. | |
| 2019/0071340 | A1 | 3/2019 | Imrie | |
| 2020/0149362 | A1 | 5/2020 | Terwilliger et al. | |
| 2020/0149556 | A1 | 5/2020 | Judge et al. | |
| 2020/0149557 | A1 | 5/2020 | Le Doux, Jr. et al. | |
| 2020/0149657 | A1 | 5/2020 | Christian et al. | |
| 2020/0150698 | A1 | 5/2020 | Judge et al. | |

FOREIGN PATENT DOCUMENTS

| | | | |
|---|---|---|---|
| CN | 206158951 | U | 5/2017 |
| EP | 0163897 | B1 | 7/1988 |
| EP | 1486706 | A1 | 12/2004 |
| EP | 3177429 | A1 | 6/2017 |
| GB | 0946494 | A | 1/1964 |
| JP | 6386657 | B2 | 9/2018 |
| NZ | 503937 | A | 6/2002 |
| SG | 151056 | A1 | 5/2009 |
| SU | 348773 | A | 8/1972 |
| WO | 02/66816 | A1 | 8/2002 |
| WO | 2010/031162 | A9 | 11/2010 |
| WO | 2016/022706 | A1 | 2/2016 |
| WO | 2016/063194 | A3 | 7/2016 |
| WO | 2017/083500 | A1 | 5/2017 |
| WO | 2018/035201 | A1 | 2/2018 |
| WO | 2018/085740 | A2 | 5/2018 |

OTHER PUBLICATIONS

PCT Patent Application No. PCT/US2019/060564, Written Opinion dated Feb. 27, 2020, 6 pp.

Vorteq Pure Grit, This changes everything, Brochure, Energy Recovery Inc, 8 pages.

* cited by examiner

FLUID EXCHANGE DEVICES AND RELATED CONTROLS, SYSTEMS, AND METHODS

CROSS-REFERENCE TO RELATED APPLICATION

This application claims the benefit of the filing date of U.S. Provisional Patent Application Ser. No. 62/758,327, filed Nov. 9, 2018, for "Fluid Exchange Devices and Related Controls, Systems, and Methods," the disclosure of which is incorporated herein in its entirety by reference.

TECHNICAL FIELD

The present disclosure relates generally to exchange devices. More particularly, embodiments of the present disclosure relate to fluid exchange devices for one or more of exchanging properties (e.g., pressure) between fluids and systems and methods.

BACKGROUND

Industrial processes often involve hydraulic systems including pumps, valves, impellers, etc. Pumps, valves, and impellers may be used to control the flow of the fluids used in the hydraulic processes. For example, some pumps may be used to increase (e.g., boost) the pressure in the hydraulic system, other pumps may be used to move the fluids from one location to another. Some hydraulic systems include valves to control where a fluid flows. Valves may include control valves, ball valves, gate valves, globe valves, check valves, isolation valves, combinations thereof, etc.

Some industrial processes involve the use of caustic fluids, abrasive fluids, and/or acidic fluids. These types of fluids may increase the amount of wear on the components of a hydraulic system. The increased wear may result in increased maintenance and repair costs or require the early replacement of equipment. For example, abrasive, caustic, or acidic fluid may increase the wear on the internal components of a pump such as an impeller, shaft, vanes, nozzles, etc. Some pumps are rebuildable and an operation may choose to rebuild a worn pump replacing the worn parts which may result in extended periods of downtime for the worn pump resulting in either the need for redundant pumps or a drop in productivity. Other operations may replace worn pumps at a larger expense but a reduced amount of downtime.

Well completion operations in the oil and gas industry often involve hydraulic fracturing (often referred to as fracking or fracing) to increase the release of oil and gas in rock formations. Hydraulic fracturing involves pumping a fluid (e.g., frac fluid, fracking fluid, etc.) containing a combination of water, chemicals, and proppant (e.g., sand, ceramics) into a well at high pressures. The high pressures of the fluid increases crack size and crack propagation through the rock formation releasing more oil and gas, while the proppant prevents the cracks from closing once the fluid is depressurized. Fracturing operations use high-pressure pumps to increase the pressure of the fracking fluid. However, the proppant in the fracking fluid increases wear and maintenance on and substantially reduces the operation lifespan of the high-pressure pumps due to its abrasive nature.

BRIEF SUMMARY

Various embodiments may include a system for exchanging pressure between at least two fluid streams. The system may include a pressure exchange device including at least one high pressure inlet, at least one low pressure inlet, at least one high pressure outlet, and at least one low pressure outlet. The at least one high pressure inlet may be configured to receive a fluid at a first higher pressure. The at least one low pressure inlet may be configured to receive a downhole fluid (e.g., fracking fluid, drilling fluid) at a first lower pressure. The at least one high pressure outlet may be configured for outputting the downhole fluid at a second higher pressure that is greater than the first lower pressure. The at least one low pressure outlet may be configured for outputting the fluid at a second lower pressure that is less than the first higher pressure. The pressure exchange device may also include a valve device. The valve device may include a linear valve actuator. The valve device may be configured to selectively place the fluid at the first higher pressure in communication with the downhole fluid at the first lower pressure in order to pressurize the downhole fluid to the second higher pressure; and selectively output the fluid at the second lower pressure from the pressure exchange device through the at least one low pressure outlet. The system may also include at least one pump for supplying the fluid at the first higher pressure to the at least one high pressure inlet of the pressure device.

Another embodiment may include a system for exchanging pressure between at least two fluid streams. The system may include a pressure exchange device including a high pressure inlet, at least two low pressure inlets, at least two high pressure outlets, at least two low pressure outlets, and a valve device. The high pressure inlet may be configured to receive a fluid at a first higher pressure. The at least two low pressure inlets may be configured to receive a downhole fluid (e.g., fracking fluid, drilling fluid) at a first lower pressure. The at least two high pressure outlets may be configured to output the downhole fluid at a second higher pressure that is greater than the first lower pressure. The at least two low pressure outlets may be configure to output the fluid at a second lower pressure that is less than the first higher pressure. The valve device may include a linear valve actuator. The valve device may be configured to selectively place the fluid at the first higher pressure in communication with the downhole fluid at the first lower pressure in order to pressurize the downhole fluid to the second higher pressure, and selectively output the fluid at the second lower pressure from the pressure exchange device through one of the at least two low pressure outlets. The system may also include at least one pump for supplying the fluid at the first higher pressure to the high pressure inlet of the pressure device.

Another embodiment may include a device for exchanging pressure between at least two fluid streams. The device may include at least one high pressure inlet, at least one low pressure inlet, at least one high pressure outlet, and at least one low pressure outlet. The at least one high pressure inlet may be configured for receiving a fluid at a first higher pressure. The at least one low pressure inlet may be configured for receiving a downhole fluid (e.g., fracking fluid, drilling fluid) at a first lower pressure. The at least one high pressure outlet may be configured for outputting the downhole fluid at a second higher pressure that is greater than the first lower pressure. The at least one low pressure outlet may be configured for outputting the fluid at a second lower pressure that is less than the first higher pressure. The device may also include a valve device. The valve device may be configured to selectively place the fluid at the first higher pressure in communication with the downhole fluid at the first lower pressure in order to pressurize the downhole fluid to the second higher pressure. The valve device may also be configured to selectively output the fluid at the second lower pressure from the pressure exchange device through the at least one low pressure outlet. The device may also include at least one tank. The at least one tank may be in communication with the at least on high pressure outlet, the at least one low pressure inlet, the at least one high pressure inlet, and the at least one low pressure inlet. The at least one high pressure outlet and the at least one low pressure inlet may be positioned on a first end of the at least one tank. The at least one high pressure inlet and the at least one low pressure outlet may be positioned on the valve device.

Another embodiment may include a method of exchanging pressure between at least two fluid streams. The method may include receiving a fluid at a first higher pressure into a pressure exchanger from a high pressure inlet and receiving a downhole fluid (e.g., fracking fluid, drilling fluid) at a first lower pressure into the pressure exchanger from a first low pressure inlet. The fluid at the first higher pressure may be placed in communication with the downhole fluid at the first lower pressure in order to pressurize the downhole fluid to a second higher pressure that is greater than the first lower pressure. The downhole fluid may be output at a second higher pressure. The method may also include receiving additional fluid at the first higher pressure into the pressure exchanger from the high pressure inlet, and receiving additional downhole fluid into the pressure exchanger from a second low pressure inlet.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

MODE(S) FOR CARRYING OUT THE INVENTION

Figure 1:
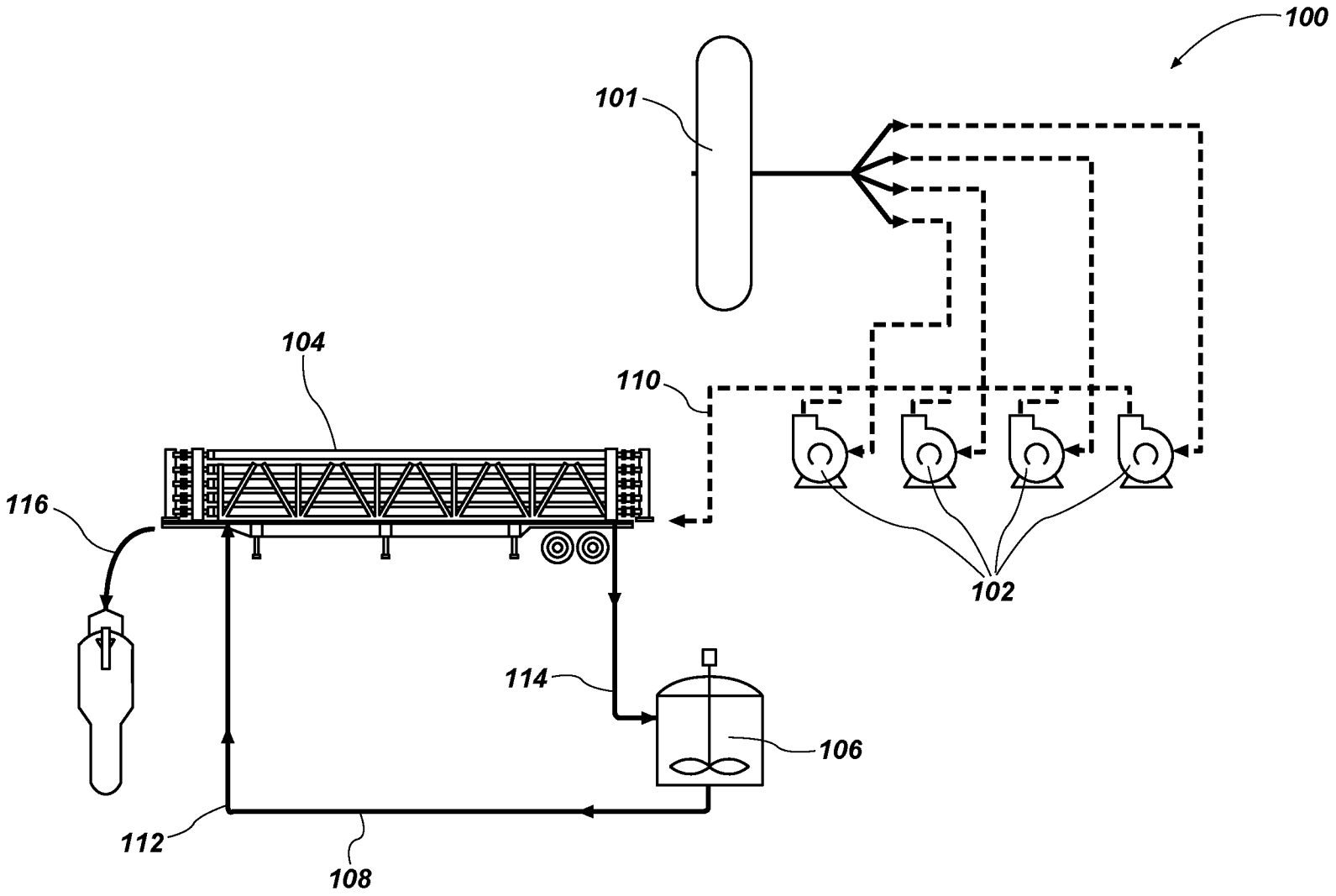
FIG. 1 is schematic view of a hydraulic fracturing system according to an embodiment of the present disclosure.

The illustrations presented herein are not meant to be actual views of any particular fluid exchanger or component thereof, but are merely idealized representations employed to describe illustrative embodiments. The drawings are not necessarily to scale. Elements common between figures may retain the same numerical designation.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

As used herein, the term "substantially" or "about" in reference to a given parameter means and includes to a degree that one skilled in the art would understand that the given parameter, property, or condition is met with a small degree of variance, such as within acceptable manufacturing tolerances. For example, a parameter that is substantially met may be at least 90% met, at least 95% met, at least 99% met, or even 100% met.

As used herein, the term "fluid" may mean and include fluids of any type and composition. Fluids may take a liquid form, a gaseous form, or combinations thereof, and, in some instances, may include some solid material. In some embodiments, fluids may convert between a liquid form and a gaseous form during a cooling or heating process as described herein. In some embodiments, the term fluid includes gases, liquids, and/or pumpable mixtures of liquids and solids.

Embodiments of the present disclosure may relate to exchange devices that may be utilized to exchange one or more properties between fluids (e.g., a pressure exchanger). Such exchangers (e.g., pressure exchangers) are sometimes called "flow-work exchangers" or "isobaric devices" and are machines for exchanging pressure energy from a relatively high-pressure flowing fluid system to a relatively low-pressure flowing fluid system.

In some industrial processes, elevated pressures are required in certain parts of the operation to achieve the desired results, following which the pressurized fluid is depressurized. In other processes, some fluids used in the process are available at high-pressures and others at low-pressures, and it is desirable to exchange pressure energy between these two fluids. As a result, in some applications, great improvement in economy can be realized if pressure can be efficiently transferred between two fluids.

In some embodiments, exchangers as disclosed herein may be similar to and include the various components and configurations of the pressure exchangers disclosed in U.S. Pat. No. 5,797,429 to Shumway, issued Aug. 25, 1998, the disclosure of which is hereby incorporated herein in its entirety by this reference.

Although some embodiments of the present disclosure are depicted as being used and employed as a pressure exchanger between two or more fluids, persons of ordinary skill in the art will understand that the embodiments of the present disclosure may be employed in other implementations such as, for example, the exchange of other properties (e.g., temperature, density, etc.) and/or composition between one or more fluids and/or mixing of two or more fluids.

In some embodiments, a pressure exchanger may be used to protect moving components (e.g., pumps, valves, impellers, etc.) in processes were high pressures are needed in a fluid that has the potential to damage the moving components (e.g., abrasive fluid, caustic fluid, acidic fluid, etc.).

For example, pressure exchange devices according to embodiments of the disclosure may be implemented in hydrocarbon related processes, such as, hydraulic fracturing or other drilling operations (e.g., subterranean downhole drilling operations).

As discussed above, well completion operations in the oil and gas industry often involve hydraulic fracturing, drilling operations, or other downhole operations that use high-pressure pumps to increase the pressure of the downhole fluid (e.g., fluid that is intended to be conducted into a subterranean formation or borehole, such as, fracking fluid, drilling fluid, drilling mud). The proppants, chemicals, additives to produce mud, etc. in these fluids often increase wear and maintenance on the high-pressure pumps.

In some embodiments, a hydraulic fracturing system may include a hydraulic energy transfer system that transfers pressure between a first fluid (e.g., a clean fluid, such as a partially (e.g., majority) or substantially proppant free fluid or a pressure exchange fluid) and a second fluid (e.g., fracking fluid, such as a proppant-laden fluid, an abrasive fluid, or a dirty fluid). Such systems may at least partially (e.g., substantially, primarily, entirely) isolate the high-pressure first fluid from the second dirty fluid while still enabling the pressurizing of the second dirty fluid with the high-pressure first fluid and without having to pass the second dirty fluid directly through a pump or other pressurizing device.

While some embodiments discussed herein may be directed to fracking operations, in additional embodiments, the exchanger systems and devices disclosed herein may be utilized in other operations. For example, devices, systems, and/or method disclosed herein may be used in other downhole operations, such as, for example, downhole drilling operations.

FIG. 1 illustrates a system diagram of an embodiment of hydraulic fracturing system 100 utilizing a pressure exchanger between a first fluid stream (e.g., clean fluid stream) and a second fluid stream (e.g., a fracking fluid stream). Although not explicitly described, it should be understood that each component of the system 100 may be directly connected or coupled via a fluid conduit (e.g., pipe) to an adjacent (e.g., upstream or downstream) component. The hydraulic fracturing system 100 may include one or more devices for pressurizing the first fluid stream, such as, for example, frack pumps 102 (e.g., reciprocating pumps, centrifugal pumps, scroll pumps, etc.). The system 100 may include multiple frack pumps 102, such as at least two frack pumps 102, at least four frack pumps 102, at least ten frack pumps 102, at least sixteen frack pumps, or at least twenty frack pumps 102. In some embodiments, the frack pumps 102 may provide relatively and substantially clean fluid at a high pressure to a pressure exchanger 104 from a fluid source 101. In some embodiments, fluid may be provided separately to each pump 102 (e.g., in a parallel configuration). After pressurization in the pumps 102, the high pressure clean fluid 110 may be combined and transmitted to the pressure exchanger 104 (e.g., in a serial configuration).

As used herein, "clean" fluid may describe fluid that is at least partially or substantially free (e.g., substantially entirely or entirely free) of chemicals and/or proppants typically found in a downhole fluid and "dirty" fluid may describe fluid that at least partially contains chemicals and/or proppants typically found in a downhole fluid.

The pressure exchanger 104 may transmit the pressure from the high pressure clean fluid 110 to a low pressure fracking fluid (e.g., fracking fluid 112) in order to provide a high pressure fracking fluid 116. The clean fluid may be expelled from the pressure exchanger 104 as a low pressure fluid 114 after the pressure is transmitted to the low pressure fracking fluid 112. In some embodiments, the low pressure fluid 114 may be an at least partially or substantially clean fluid that substantially lacks chemicals and/or proppants aside from a small amount that may be passed to the low pressure fluid 114 from the fracking fluid 112 in the pressure exchanger 104.

In some embodiments, the pressure exchanger 104 may include one or more pressure exchanger devices (e.g., operating in parallel). In such configurations, the high pressure inputs may be separated and provided to inputs of each of the pressure exchanger devices. The outputs of each of the pressure exchanger devices may be combined as the high pressure fracking fluid exits the pressure exchanger 104. For example, and as discussed below with reference to FIG. 4, the pressure exchanger 104 may include two or more (e.g., three) pressure exchanger devices operating in parallel and oriented in a substantially parallel configuration. As depicted, the pressure exchanger 104 may be provided on a mobile platform (e.g., a truck trailer) that may be relatively easily installed and removed from a fracking well site.

After being expelled from the pressure exchanger 104, the low pressure clean fluid 114 may travel to and be collected in a mixing chamber 106 (e.g., blender unit, mixing unit, etc.). In some embodiments, the low pressure fluid 114 may be converted (e.g., modified, transformed, etc.) to the low pressure fracking fluid 112 in the mixing chamber 106. For example, a proppant may be added to the low pressure clean fluid 114 in the mixing chamber 106 creating a low pressure fracking fluid 112. In some embodiments, the low pressure clean fluid 114 may be expelled as waste.

In many hydraulic fracturing operations, a separate process may be used to heat the fracking fluid 112 before the fracking fluid 112 is discharged downhole (e.g., to ensure proper blending of the proppants in the fracking fluid). In some embodiments, using the low pressure clean fluid 114 to produce the fracking fluid 112 may eliminate the step of heating the fracking fluid. For example, the low pressure clean fluid 114 may be at an already elevated temperature as a result of the fracking pumps 102 pressurizing the high pressure clean fluid 110. After transferring the pressure in the high pressure clean fluid 112 that has been heated by the pumps 102, the now low pressure clean fluid 114 retains at least some of that heat energy as it is passed out of the pressure exchanger 104 to the mixing chamber 106. In some embodiments, using the low pressure clean fluid 114 at an already elevated temperature to produce the fracking fluid may result in the elimination of the heating step for the fracking fluid. In other embodiments, the elevated temperature of the low pressure clean fluid 114 may result in a reduction of the amount of heating required for the fracking fluid.

After the proppant is added to the low pressure now fracking fluid 114, the low pressure fracking fluid 112 may be expelled from the mixing chamber 106. The low pressure fracking fluid 112 may then enter the pressure exchanger 104 on the fracking fluid end through a fluid conduit 108 connected (e.g., coupled) between the mixing chamber 106 and the pressure exchanger 104. Once in the pressure exchanger 104, the low pressure fracking fluid 112 may be pressurized by the transmission of pressure from the high pressure clean fluid 110 through the pressure exchanger 104. The high pressure fracking fluid 116 may then exit the pressure exchanger 104 and be transmitted downhole.

Hydraulic fracturing systems generally require high operating pressures for the high pressure fracking fluid 116. In some embodiments, the desired pressure for the high pressure fracking fluid 116 may be between about 8,000 PSI (55,158 kPa) and about 12,000 PSI (82,737 kPa), such as between about 9,000 PSI (62,052 kPa) and about 11,000 PSI (75,842 kPa), or about 10,000 PSI (68,947 kPa).

In some embodiments, the high pressure clean fluid 110 may be pressurized to a pressure at least substantially the same or slightly greater than the desired pressure for the high pressure fracking fluid 116. For example, the high pressure clean fluid 110 may be pressurized to between about 0 PSI (0 kPa) and about 1000 PSI (6,894 kPa) greater than the desired pressure for the high pressure fracking fluid 116, such as between about 200 PSI (1,379 kPa) and about 700 PSI (4,826 kPa) greater than the desired pressure, or between about 400 PSI (2,758 kPa) and about 600 PSI (4,137 kPa) greater than the desired pressure, to account for any pressure loss during the pressure and exchange process.

Figure 2:
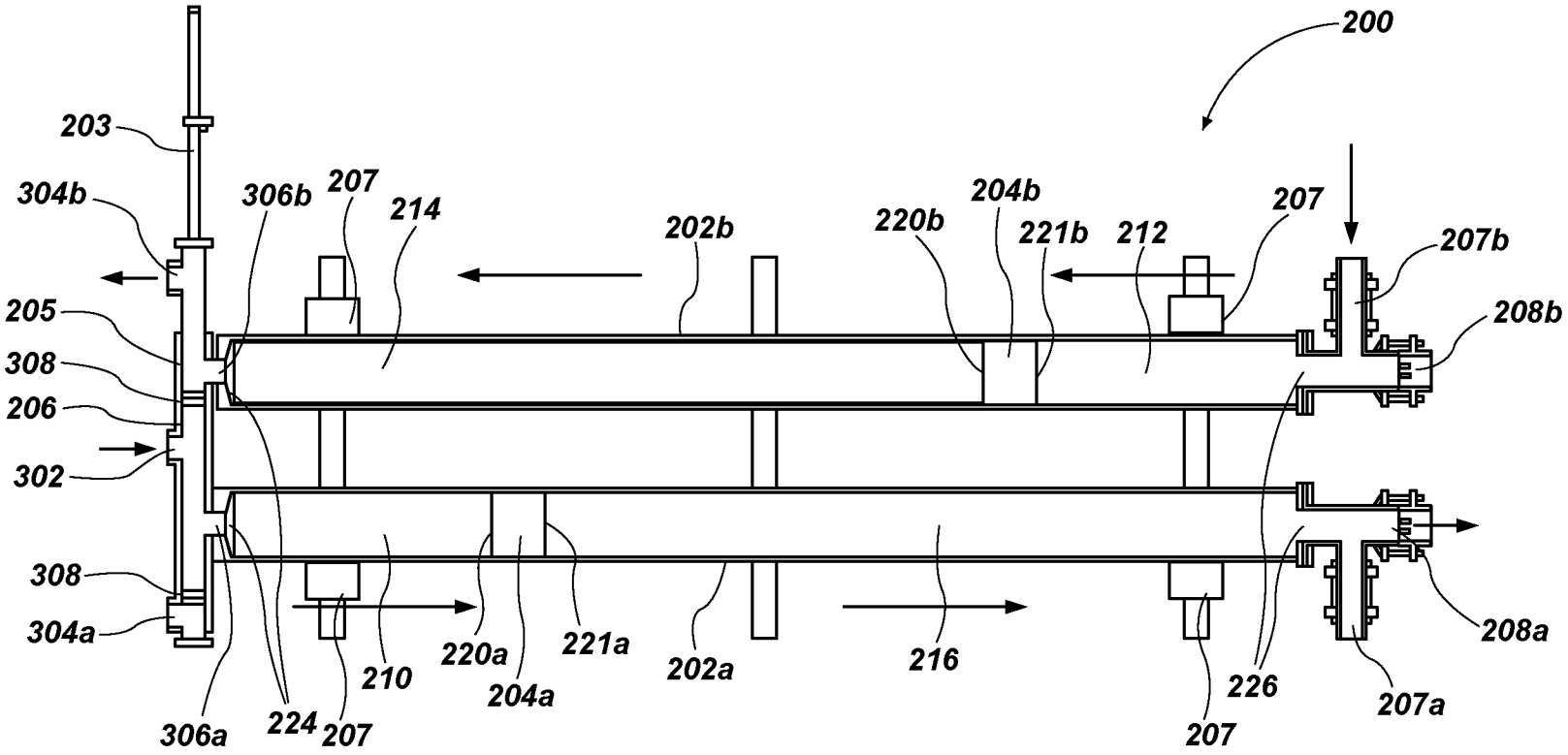
FIG. 2 is cross-sectional view of a fluid exchanger device according to an embodiment of the present disclosure.

FIG. 2 illustrates an embodiment of a pressure exchanger 200. The pressure exchanger 200 may be a linear pressure exchanger in the sense that it is operated by moving or translating an actuation assembly substantially along a linear path. For example, the actuation assembly may be moved linearly to selectively place the low and high pressure fluids in at least partial communication (e.g., indirect communication where the pressure of the high pressure fluid may be transferred to the low pressure fluid) as discussed below in greater detail.

The linear pressure exchanger 200 may include one or more (e.g., two) chambers 202*a*, 202*b* (e.g., tanks, collectors, cylinders, tubes, pipes, etc.). The chambers 202*a*, 202*b* (e.g., parallel chambers 202*a*, 202*b*) may include pistons 204*a*, 204*b* configured to substantially maintain the high pressure clean fluid 210 and low pressure clean fluid 214 (e.g., the clean side) separate from the high pressure dirty fluid 216 and the low pressure dirty fluid 212 (e.g., the dirty side) while enabling transfer of pressure between the respective fluids 210, 212, 214, and 216. The pistons 204*a*, 204*b* may be sized (e.g., the outer diameter of the pistons 204*a*, 204*b* relative to the inner diameter of the chambers 202*a*, 204*b*) to enable the pistons 204*a*, 204*b* to travel through the chamber 202*a*, 202*b* while minimizing fluid flow around the pistons 204*a*, 204*b*.

The linear pressure exchanger 200 may include a clean control valve 206 configured to control the flow of high pressure clean fluid 210 and low pressure clean fluid 214. Each of the chambers 202*a*, 202*b* may include one or more dirty control valves 207*a*, 207*b*, 208*a*, and 208*b* configured to control the flow of the low pressure dirty fluid 212 and the high pressure dirty fluid 216.

While the embodiment of FIG. 2 contemplates a linear pressure exchanger 200, other embodiments, may include other types of pressure exchangers that involve other mechanisms for selectively placing the low and high pressure fluids in at least partial communication (e.g., a rotary actuator such as those disclosed in U.S. Pat. No. 9,435,354, issued Sep. 6, 2016, the disclosure of which is hereby incorporated herein in its entirety by this reference, etc.).

In some embodiments, the clean control valve 206, which includes an actuation stem 203 that moves one or more stoppers 308 along (e.g., linearly along) a body 205 of the valve 206, may selectively allow (e.g., input, place, etc.) high pressure clean fluid 210 provided from a high pressure inlet port 302 to enter a first chamber 202*a* on a clean side 220*a* of the piston 204*a*. The high pressure clean fluid 210 may act on the piston 204*a* moving the piston 204*a* in a direction toward the dirty side 221*a* of the piston 204*a* and compressing the dirty fluid in the first chamber 202*a* to produce the high pressure dirty fluid 216. The high pressure dirty fluid 216 may exit the first chamber 202*a* through the dirty discharge control valve 208*a* (e.g., outlet valve, high pressure outlet). At substantially the same time, the low pressure dirty fluid 212 may be entering the second chamber 202*b* through the dirty fill control valve 207*b* (e.g., inlet valve, low pressure inlet). The low pressure dirty fluid 212 may act on the dirty side 221*b* of the piston 204*b* moving the piston 204*b* in a direction toward the clean side 220*b* of the piston 204*b* in the second chamber 202*b*. The low pressure clean fluid 214 may be discharged (e.g., emptied, expelled, etc.) through the clean control valve 206 as the piston 204*b* moves in a direction toward the clean side 220*b* of the piston 204*b* reducing the space on the clean side 220*b* of the piston 204*b* within the second chamber 202*b*. A cycle of the pressure exchanger is completed once each piston 204*a*, 204*b* moves the substantial length (e.g., the majority of the length) of the respective chamber 202*a*, 202*b* (which "cycle" may be a half cycle with the piston 204*a*, 204*b* moving in one direction along the length of the chamber 202*a*, 202*b* and a full cycle includes the piston 204*a*, 204*b* moving in the one direction along the length of the chamber 202*a*, 202*b* and then moving in the other direction to return to substantially the original position). In some embodiments, only a portion of the length may be utilized (e.g., in reduced capacity situations). Upon the completion of a cycle, the actuation stem 203 of the clean control valve 206 may change positions enabling the high pressure clean fluid 210 to enter the second chamber 202*b*, thereby changing the second chamber 202*b* to a high pressure chamber and changing the first chamber 202*a* to a low pressure chamber and repeating the process.

In some embodiments, each chamber 202*a*, 202*b* may have a higher pressure on one side of the pistons 204*a*, 204*b* to move the piston in a direction away from the higher pressure. For example, the high pressure chamber may experience pressures between about 8,000 PSI (55,158 kPa) and about 13,000 PSI (89,632 kPa) with the highest pressures being in the high pressure clean fluid 210 to move the piston 204*a*, 204*b* away from the high pressure clean fluid 210 compressing and discharging the dirty fluid to produce the high pressure dirty fluid 216. The low pressure chamber 202*a*, 202*b* may experience much lower pressures, relatively, with the relatively higher pressures in the currently low pressure chamber 202*a*, 202*b* still being adequate enough in the low pressure dirty fluid 212 to move the piston 204*a*, 204*b* in a direction away from the low pressure dirty fluid 212 discharging the low pressure clean fluid 214. In some embodiments, the pressure of the low pressure dirty fluid 212 may be between about 100 PSI (689 kPa) and about 700 PSI (4,826 kPa), such as between about 200 PSI (1,379 kPa) and about 500 PSI (3,447 kPa), or between about 300 PSI (2,068 kPa) and about 400 PSI (2758 kPa).

Referring back to FIG. 1, in some embodiments, the system 100 may include one or more optional devices (e.g., a pump) to pressurize the low pressure dirty fluid 212 (e.g., to a pressure level that is suitable to move the piston 204*a*, 204*b* toward the clean side) as it is being provided into the chambers 202*a*, 202*b*.

Referring again to FIG. 2, if any fluid pushes past the piston 204*a*, 204*b* (e.g., leak by, blow by, etc.) it will generally tend to flow from the higher pressure fluid to the lower pressure fluid. The high pressure clean fluid 210 may be maintained at the highest pressure in the system such that the high pressure clean fluid 210 may not generally become substantially contaminated. The low pressure clean fluid 214 may be maintained at the lowest pressure in the system. Therefore, it is possible that the low pressure clean fluid 214 may become contaminated by the low pressure dirty fluid 212. In some embodiments, the low pressure clean fluid 214 may be used to produce the low pressure dirty fluid 212 substantially nullifying any detriment resulting from the contamination. Likewise, any contamination of the high pressure dirty fluid 216 by the high pressure clean fluid 210 would have minimal effect on the high pressure dirty fluid 216.

In some embodiments, the dirty control valves 207*a*, 207*b*, 208*a*, 208*b* may be check valves (e.g., clack valves, non-return valves, reflux valves, retention valves, or one-way valves). For example, one or more of the dirty control valves 207*a*, 207*b*, 208*a*, 208*b* may be a ball check valve, diaphragm check valve, swing check valve, tilting disc check valve, clapper valve, stop-check valve, lift-check valve, in-line check valve, duckbill valve, etc. In additional embodiments, one or more of the dirty control valves 207*a*, 207*b*, 208*a*, and 208*b* may be actuated valves (e.g., solenoid valves, pneumatic valves, hydraulic valves, electronic valves, etc.) configured to receive a signal from a controller and open or close responsive the signal.

The dirty control valves 207*a*, 207*b*, 208*a*, 208*b* may be arranged in opposing configurations such that when the chamber 202*a*, 202*b* is in the high pressure configuration the high pressure dirty fluid opens the dirty discharge control valve 208*a*, 208*b* while the pressure in the chamber 202*a*, 202*b* holds the dirty fill control valve 207*a*, 207*b* closed. For example, the dirty discharge control valve 208*a*, 208*b* comprises a check valve that opens in a first direction out of the chamber 202*a*, 202*b*, while the dirty fill control valve 207*a*, 207*b* comprises a check valve that opens in a second, opposing direction into the chamber 202*a*, 202*b*.

The dirty discharge control valves 208*a*, 208*b* may be connected to a downstream element (e.g., a fluid conduit, a separate or common manifold) such that the high pressure in the downstream element holds the dirty discharge valve 208*a*, 208*b* closed in the chamber 202*a*, 202*b* that is in the low pressure configuration. Such a configuration enables the low pressure dirty fluid to open the dirty fill control valve 207*a*, 207*b* and enter the chamber 202*a*, 202*b*.

Figure 3A:
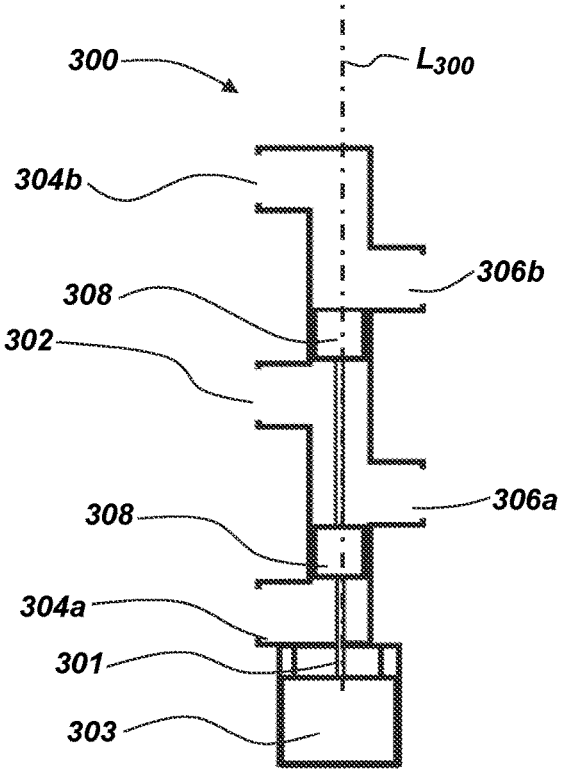
FIG. 3A is a cross-sectional view of a control valve in a first position according to an embodiment of the present disclosure.
Figure 3B:
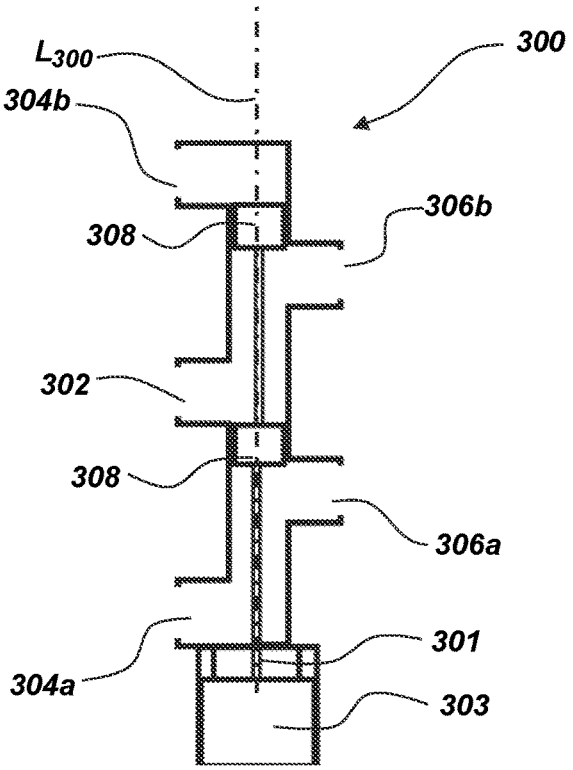
FIG. 3B is a cross-sectional view of a control valve in a second position according to an embodiment of the present disclosure.

FIGS. 3A and 3B illustrate a cross sectional view of an embodiment of a clean control valve 300 at two different positions. In some embodiments, the clean control valve 300 may be similar to the control valve 206 discussed above. The clean control valve 300 may be a multiport valve (e.g., 4 way valve, 5 way valve, LinX® valve, etc.). The clean control valve 300 may have one or more high pressure inlet ports (e.g., one port 302), one or more low pressure outlet ports (e.g., two ports 304*a*, 304*b*), and one or more chamber connection ports (e.g., two ports 306*a*, 306*b*). The clean control valve 300 may include at least two stoppers 308 (e.g., plugs, pistons, discs, valve members, etc.). In some embodiments, the clean control valve 300 may be a linearly actuated valve. For example, the stoppers 308 may be linearly actuated such that the stoppers 308 move along a substantially straight line (e.g., along a longitudinal axis $L_{300}$ of the clean control valve 300).

The clean control valve 300 may include an actuator 303 configured to actuate the clean control valve 300 (e.g., an actuator coupled to a valve stem 301 of the clean control valve 300). In some embodiments, the actuator 303 may be electronic (e.g., solenoid, rack and pinion, ball screw, segmented spindle, moving coil, etc.), pneumatic (e.g., tie rod cylinders, diaphragm actuators, etc.), or hydraulic. In some embodiments, the actuator 303 may enable the clean control valve 300 to move the valve stem 301 and stoppers 308 at variable rates (e.g., changing speeds, adjustable speeds, etc.).

FIG. 3A illustrates the clean control valve 300 in a first position. In the first position, the stoppers 308 may be positioned such that the high pressure clean fluid may enter the clean control valve 300 through the high pressure inlet port 302 and exit into a first chamber through the chamber connection port 306*a*. In the first position, the low pressure clean fluid may travel through the clean control valve 300 between the chamber connection port 306*b* and the low pressure outlet port 304*b* (e.g., may exit through the low pressure outlet port 304*b*).

FIG. 3B illustrates the clean control valve 300 in a second position. In the second position, the stoppers 308 may be positioned such that the high pressure clean fluid may enter the clean control valve 300 through the high pressure inlet port 302 and exit into a second chamber through the chamber connection port 306*b*. The low pressure clean fluid may travel through the clean control valve 300 between the chamber connection port 306*a* and the low pressure outlet port 304*a* (e.g., may exit through the low pressure outlet port 304*a*).

Now referring to FIGS. 2, 3A, and 3B, the clean control valve 206 is illustrated in the first position with the high pressure inlet port 302 connected to the chamber connection port 306*a* providing high pressure clean fluid to the first chamber 202*a*. Upon completion of the cycle, the clean control valve 206 may move the stoppers 308 to the second position thereby connecting the high pressure inlet port 302 to the second chamber 202*b* through the chamber connection port 306*b*.

In some embodiments, the clean control valve 206 may pass through a substantially fully closed position in the middle portion of a stroke between the first position and the second position. For example, in the first position, the stoppers 308 may maintain a fluid pathway between the high pressure inlet port 302 and the chamber connection port 306*a* and a fluid pathway between the chamber connection port 306*b* and the low pressure outlet port 304*b*. In the second position, the stoppers 308 may maintain a fluid pathway between the high pressure inlet port 302 and the chamber connection port 306*b* and a fluid pathway between the chamber connection port 306*a* and the low pressure outlet port 304*a*. Transitioning between the first and second positions may involve at least substantially closing both fluid pathways to change the connection of the chamber connection port 306*a* from the high pressure inlet port 302 to the low pressure outlet port 304*a* and to change the connection of the chamber connection port 306*b* from the low pressure outlet port 306*b* to the high pressure inlet port 302. The fluid pathways may at least substantially close at a middle portion of the stroke to enable the change of connections. Opening and closing valves, where fluids are operating at high pressures, may result in pressure pulsations (e.g., water hammer) that can result in damage to components in the system when high pressure is suddenly introduced or removed from the system. As a result, pressure pulsations may occur in the middle portion of the stroke when the fluid pathways are closing and opening respectively.

In some embodiments, the actuator 303 may be configured to move the stoppers 308 at variable speeds along the stroke of the clean control valve 206. As the stoppers 308 move from the first position to the second position, the stoppers 308 may move at a high rate of speed while traversing a first portion of the stroke that does not involve newly introducing flow from the high pressure inlet port 302 into the chamber connection ports 306*a*, 306*b*. The stoppers 308 may decelerate to a low rate of speed as the stoppers 308 approach a closed position (e.g., when the stoppers 308 block the chamber connection ports 306*a*, 306*b* during the transition between the high pressure inlet port 302 connection and the low pressure outlet port 304*a*, 304*b* connection)

at a middle portion of the stroke. The stoppers 308 may continue at a lower rate of speed, as the high pressure inlet port 302 is placed into communication with one of the chamber connection ports 306*a*, 306*b*. After traversing the chamber connection ports 306*a*, 306*b*, the stoppers 308 may accelerate to another high rate of speed as the stoppers 308 approach the second position. The low rate of speed in the middle portion of the stroke may reduce the speed that the clean control valve 206 opens and closes enabling the clean control valve to gradually introduce and/or remove the high pressure from the chambers 202*a*, 202*b*.

In some embodiments, the motion of the pistons 204*a*, 204*b* may be controlled by regulating the rate of fluid flow (e.g., of the incoming fluid) and/or a pressure differential between the clean side 220*a*, 220*b* of the pistons 204*a*, 204*b*, and the dirty side 221*a*, 221*b* of the pistons 204*a*, 204*b* at least partially with the movement of the clean control valve 206. In some embodiments, it may be desirable for the piston 204*a*, 204*b* in the low pressure chamber 202*a*, 202*b* to move at substantially the same speed as the piston 204*a*, 204*b* in the high pressure chamber 202*a*, 202*b* either by manipulating their pressure differentials in each chamber and/or by controlling the flow rates of the fluid in and out of the chambers 202*a*, 202*b*. However, the piston 204*a*, 204*b* in the low pressure chamber 202*a*, 202*b* may tend to move at a greater speed than the piston 204*a*, 204*b* in the high pressure chamber 202*a*, 202*b*.

In some embodiments, the rate of fluid flow and/or the pressure differential may be varied to control acceleration and deceleration of the pistons 204*a*, 204*b* (e.g., by manipulating and/or varying the stroke of the clean control valve 206 and/or by manipulating the pressure in the fluid streams with one or more pumps). For example, increasing the flow rate and/or the pressure of the high pressure clean fluid 210 when the piston 204*a*, 204*b* is near a clean end 224 of the chamber 202*a*, 202*b* at the beginning of the high pressure stroke may increase the rate of fluid flow and/or the pressure differential in the chamber 202*a*, 202*b*. Increasing the rate of fluid flow and/or the pressure differential may cause the piston 204*a*, 204*b* to accelerate to or move at a faster rate. In another example, the flow rate and/or the pressure of the high pressure clean fluid 210 may be decreased when the piston 204*a*, 204*b* approaches a dirty end 226 of the chamber 202*a*, 202*b* at the end of the high pressure stroke. Decreasing the rate of fluid flow and/or the pressure differential may cause the piston 204*a*, 204*b* to decelerate and/or stop before reaching the dirty end of the respective chamber 202*a*, 202*b*.

Similar control with the stroke of the clean control valve 206 may be utilized to prevent the piston 204*a*, 204*b* from traveling to the furthest extent of the clean end of the chambers 202*a*, 202*b*. For example, the clean control valve 206 may close off one of the chamber connection ports 306*a*, 306*b* before the piston 204*a*, 204*b* contacts the furthest extent of the clean end of the chambers 202*a*, 202*b* by preventing any further fluid flow and slowing and/or stopping the piston 204*a*, 204*b*. In some embodiments, the clean control valve 206 may open one the chamber connection ports 306*a*, 306*b* into communication with the high pressure inlet port 302 before the piston 204*a*, 204*b* contacts the furthest extent of the clean end of the chambers 202*a*, 202*b* in order to slow, stop, and/or reverse the motion of the piston 204*a*, 204*b*.

If the pistons 204*a*, 204*b* reach the clean end 224 or dirty end 226 of the respective chambers 202*a*, 202*b* the higher pressure fluid may bypass the piston 204*a*, 204*b* and mix with the lower pressure fluid. In some embodiments, mixing the fluids may be desirable. For example, if the pistons 204*a*, 204*b* reach the dirty end 226 of the respective chambers 202*a*, 202*b* during the high pressure stroke, the high pressure clean fluid 210 may bypass the piston 204*a*, 204*b* (e.g., by traveling around the piston 204*a*, 204*b* or through a valve in the piston 204*a*, 204*b*) flushing any residual contaminants from the surfaces of the piston 204*a*, 204*b*. In some embodiments, mixing the fluids may be undesirable. For example, if the pistons 204*a*, 204*b* reach the clean end 224 of the respective chambers 202*a*, 202*b* during the low pressure stroke, the low pressure dirty fluid 212 may bypass the piston 204*a*, 204*b* and mix with the low pressure clean fluid contaminating the clean area in the clean control valve 206 with the dirty fluid.

In some embodiments, the system 100 may prevent the pistons 204*a*, 204*b* from reaching the clean end 224 of the respective chambers 202*a*, 202*b*. For example, the clean control valve 206 may include a control device 207 (e.g., sensor, safety, switch, etc.) to trigger the change in position of the clean control valve 206 on detecting the approach of the piston 204*a*, 204*b* to the clean end 224 of the respective chamber 202*a*, 202*b* such that the system 100 may utilize the clean control valve 206 to change flow path positions before the piston 204*a*, 204*b* reaches the clean end 224 of the chamber 202*a*, 202*b*.

In some embodiments, pressure spikes may occur in the fluids. For example, pressure spikes may occur in the high pressure clean fluid 210 when the clean control valve 206 closes or opens. In some embodiments, the chambers 202*a*, 202*b* and pistons 204*a*, 204*b* may dampen (e.g., reduce, balance, etc.) any pressure spikes in the high pressure clean fluid 210 when transferring pressure from the high pressure clean fluid 210 to the dirty fluid 212 producing the high pressure dirty fluid 216 while minimizing pressure spikes.

In some embodiments, duration of each cycle may correlate to the production of the system 100. For example, in each cycle the pressure exchanger 200 may move a specific amount of dirty fluid defined by the combined capacity of the chambers 202*a*, 202*b*. In some embodiments, the pressure exchanger 200 may move between about 40 gallons (75.7 liters) and about 90 gallons (340.7 liters), such as between about 60 gallons (227.1 liters) and about 80 gallons (302.8 liters), or between about 65 gallons (246.1 liters) and about 75 gallons (283.9 liters). For example, in a system with one or more tanks (e.g., two tanks), each tank in the pressure exchanger 200 may move between about 40 gallons (75.7 liters) and about 90 gallons (340.7 liters) (e.g., two about 60 gallon (227.1 liters) tanks that move about 120 gallons (454.2 liters) per cycle).

In some embodiments, the duration of the cycles may be controlled by varying the rate of fluid flow and/or the pressure differential across the pistons 204*a*, 204*b* with the clean control valve 206. For example, the flow rate and/or pressure of the high pressure clean fluid 210 may be controlled such that the cycles correspond to a desired flow rate of the dirty fluid 112. In some embodiments, the flow rate and/or the pressure may be controlled by controlling a speed of the frac pumps 102 (FIG. 1) (e.g., through a variable frequency drive (VFD), throttle control, etc.), through a mechanical pressure control (e.g., variable vanes, pressure relief system, bleed valve, etc.), or by changing the position of the clean control valve 206 to restrict flow into or out of the chambers 202*a*, 202*b*.

In some embodiments, maximum production may be the desired condition which may use the shortest possible duration of the cycle. In some embodiments, the shortest duration of the cycle may be defined by the speed of the actuator 303 on the clean control valve 206, 300. In some embodiments, the shortest duration of the cycle may be defined by the maximum pressure of the high pressure clean fluid 210. In some embodiments, the shortest duration may be defined by the response time of the clean control valve 206, 300.

Now referring to FIGS. 1 and 2, in some embodiments, the pressure exchanger 104 may be formed from multiple linear pressure exchangers 200 operating in parallel. For example the pressure exchanger 104 may be formed from two or more pressure exchangers (e.g., three, four, five, or more pressure exchangers stacked in a parallel configuration. In some embodiments, the pressure exchanger 104 may be modular such that the number of linear pressure exchangers 200 may be changed by adding or removing sections of linear pressure exchangers based on flow requirements. In some embodiments, an operation may include multiple systems operating in an area and the pressure exchangers 104 for each respective system may be adjusted as needed by adding or removing linear pressure exchangers from other systems in the same area.

Figure 4:
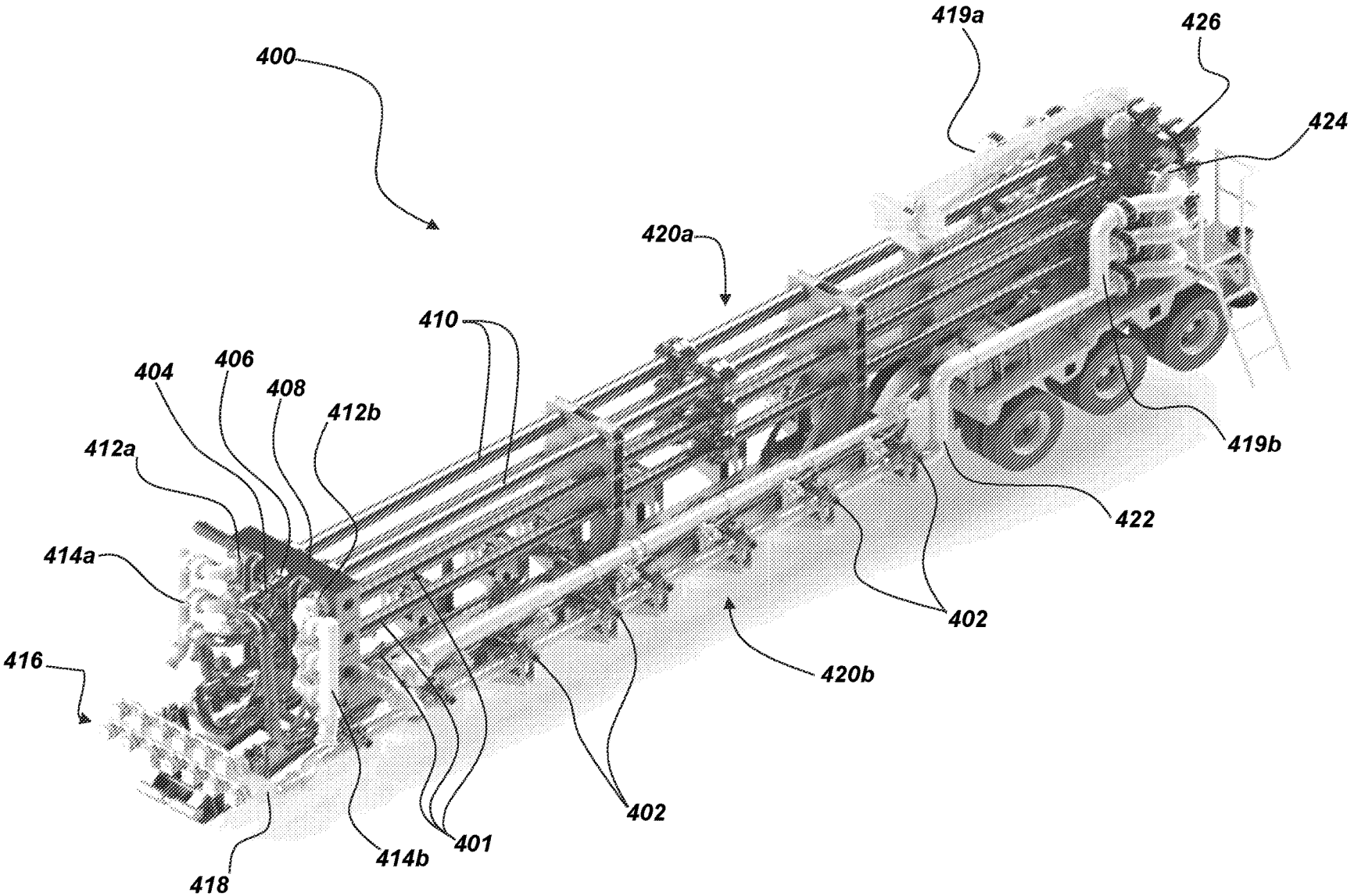
FIG. 4 is an isometric view of a modular fluid exchanger device according to an embodiment of the present disclosure.

FIG. 4 illustrates an embodiment of a pressure exchanger 400, which may be module as the number of the individual pressure exchanger devices 401. In some embodiments, the pressure exchanger 400 may be constructed into or on a mobile platform, such as, for example, a tractor trailer (e.g., semi-trailer, flat-bed trailer, etc.). In some embodiments, the pressure exchanger 400 may include multiple high pressure inlets 402 (e.g., couplings, connections, etc.) configured to connect to a high pressure supply such as high pressure pumps (e.g., frac pumps 102 (FIG. 1)). The high pressure inlets 402 may be connected to a high pressure clean manifold 404. The high pressure clean manifold 404 may be connected to the high pressure inlet port 406 of the clean control valve 408. In some embodiments, the high pressure clean manifold 404 may connect to more than one clean control valves 408 such as at two clean control valves 408, three clean control valves 408, five clean control valves 408, or eight clean control valves. The clean control valve(s) 408 may be connected to chambers 410 in a similar manner to that describe in FIG. 2 above. In some embodiments, the number of chambers 410 may correlate to the number of clean control valves 408. For example, each clean control valve 408 may be associated with two chambers 410. For example, embodiments with three clean control valves 408 may include six chambers 410, embodiments with four clean control valves 408 may include eight chambers 410, embodiments with six clean control valves 408 may include twelve chambers 410, etc.

In some embodiments, the low pressure outlet ports 412*a* and 412*b* of the clean control valve 408 may be connected to a low pressure clean manifold. The low pressure clean manifold may include a coupling (e.g., connection, fitting, etc.) configured to connect the low pressure clean manifold to an external device. In some embodiments, the pressure exchanger 400 may include more than one low pressure clean manifolds 414*a*, 414*b*. For example, a first low pressure clean manifold 414*a* may be connected to a first low pressure outlet port 412*a* of the clean control valve 408 and a second low pressure clean manifold 414*b* may be connected to a second low pressure outlet port 412*b* of the clean control valve 408. In some embodiments, the external device may be a mixing chamber configured to mix the low pressure clean fluid with a material to produce the dirty fluid (e.g., fracking fluid) for further processing. In some embodiments, the external device may be a waste tank or a drain line configured to expel the used clean fluid as waste.

In some embodiments, the pressure exchanger 400 may include low pressure inlets 416. The low pressure inlets 416 may be configured to receive a low pressure dirty fluid. In some embodiments, the low pressure inlets 416 may be connected to a low pressure dirty manifold 418. In some embodiments, the low pressure inlets 416 may be connected to at least two low pressure dirty manifolds 419*a*, 419*b*. For example, half of the low pressure inlets 416 may be connected to a first low pressure dirty manifold 419*a* on a first side 420*a* of the pressure exchanger 400 and the other half of the low pressure inlets 416 may be connected to a second low pressure dirty manifold 419*b* on a second side 420*b* of the pressure exchanger 400. In some embodiments, the at least two low pressure dirty manifolds 419*a*, 419*b* may be connected to a common low pressure dirty manifold 418 through a fluid conduit 422 (e.g., pipe, manifold, tube, etc.). The low pressure inlets 416 may be connected to the at least two low pressure dirty manifolds 419*a*, 419*b* through the common low pressure dirty manifold 418.

In some embodiments, the at least two low pressure dirty manifolds 419*a*, 419*b* may be connected to the low pressure inlet ports 424 of the pressure exchanger 400. In some embodiments, the low pressure inlet ports 424 may be valves (e.g., check valves, control valves, etc.). The low pressure inlet ports 424 may be configured to enable the low pressure dirty fluid to enter the chambers 410.

In some embodiments, the chambers 410 may also include high pressure outlet ports 426 (e.g., control valves, check valves, etc.). In some embodiments, the high pressure outlet ports 426 may be configured to release the high pressure dirty fluid from the pressure exchanger 400. In some embodiments, the high pressure outlet ports 426 may be configured to be coupled to an external processing device (e.g. well head, hydraulic system, etc.)

In some embodiments, each clean control valve 408 and the associated chambers 410 may operate independently from the adjacent clean control valves 408 and chambers 410 that may be connected through the high pressure clean manifold 404, low pressure clean manifolds 414*a*, 414*b*, or low pressure dirty manifolds 419*a*, 419*b*. The independent clean control valves 408 and associated chambers 410 may be arranged such that more than one clean control valve 408 and associated chambers 410 may be included on one tractor trailer (e.g., fit within the footprint of the associated tractor trailer). In some embodiments, the independent clean control valves 408 and chambers 410 may be configured in a substantially vertical stack with the clean control valves 408 in a substantially horizontal orientation. In some embodiments, the independent clean control valves 408 and chambers 410 may be configured in a substantially horizontal stack with the clean control valves 408 in a substantially vertical orientation.

Embodiments of the instant disclosure may provide systems including pressure exchangers that may act to reduce the amount of wear experienced by high pressure pumps, turbines, and valves in systems with abrasive, caustic, or acidic fluids. The reduced wear may enable the systems to operate for longer periods with less down time and costs associated with repair and/or replacement of components of the system resulting in increased revenue or productivity for the systems. In operations, such as fracking operations, where abrasive fluids are used at high temperatures, repairs, replacement, and downtime of components of the system can result in millions of dollars of losses in a single operation. Embodiments of the present disclosure may result in a reduction in wear experienced by the components of systems where abrasive, caustic, or acidic fluids are used at high temperatures. The reduction in wear will generally result in cost reduction and increased revenue production.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated by the inventors.

What is claimed is:

1. A system for exchanging pressure between at least two fluid streams, the system comprising:

a pressure exchange device comprising:

at least one tank;

at least one high pressure inlet in communication with the at least one tank and for receiving a fluid at a first higher pressure into the at least one tank;

at least one low pressure inlet in communication with the at least one tank and for receiving a downhole fluid at a first lower pressure into the at least one tank;

at least one high pressure outlet in communication with the at least one tank and for outputting the downhole fluid from the at least one tank at a second higher pressure that is greater than the first lower pressure;

at least one low pressure outlet in communication with the at least one tank and for outputting the fluid from the at least one tank at a second lower pressure that is less than the first higher pressure;

a valve device comprising a linear valve actuator, wherein the valve actuator is configured to move one or more valve members at variable rates along a stroke of the linear valve actuator in order to selectively fill and empty the at least one tank in communication with the at least one low pressure outlet and the at least one high pressure inlet, the system and the valve device configured to:

move the valve actuator at a first higher rate of speed when in communication with a low pressure outlet;

move the valve actuator at a second lower rate of speed that is less than the first higher rate of speed when transitioning into communication with the high pressure inlet;

selectively place the fluid at the first higher pressure in communication with the downhole fluid at the first lower pressure in order to pressurize the downhole fluid to the second higher pressure; and selectively output the fluid at the second lower pressure from the pressure exchange device through the at least one low pressure outlet; and at least one pump for supplying the fluid at the first higher pressure to the at least one high pressure inlet of the pressure device.

2. The system of claim 1, wherein the at least one low pressure outlet is coupled to the at least one low pressure inlet by a fluid conduit.

3. The system of claim 2, further comprising a blender positioned between the at least one low pressure outlet and the at least one low pressure inlet, the blender configured to modify the fluid at the second lower pressure into the downhole fluid comprising a fracking fluid at the first lower pressure.

4. The system of claim 1, wherein the at least one tank of the pressure exchanger device comprises two tanks coupled to the valve device, and further comprising a piston in each of the two tanks.

5. The system of claim 4, further comprising a control device on each of the tanks, wherein the valve device is configured to alter a position of the one or more valve members in response to the control device detecting a position of the piston in one of the two tanks.

6. The system of claim 4, wherein the at least one high pressure outlet and the at least one low pressure inlet are positioned on a first end of the at least one tank, wherein the valve device is coupled to the at least one tank at a second end of the at least one tank, and wherein the at least one high pressure inlet and the at least one low pressure outlet are positioned on the valve device.

7. The system of claim 1, wherein the at least one tank of the pressure exchanger device comprises two tanks coupled to the valve device.

8. The system of claim 7, wherein the at least one low pressure inlet comprises two low pressure inlets, the at least one low pressure outlet comprises two low pressure outlets, the at least one high pressure outlet comprises two high pressure outlets, and the at least one high pressure inlet comprises only one high pressure inlet.

9. The system of claim 8, wherein the two tanks are in communication with the only one high pressure inlet, and wherein each of the two tanks are in communication with one of the two low pressure inlets, one of the at least two high pressure outlets, and one of the two low pressure outlets.

10. The system of claim 1, wherein the pressure exchanger device comprises at least two pressure exchange devices positioned in a parallel configuration.

11. The system of claim 1, further comprising additional pressure exchange devices, the pressure exchange device and the additional pressure exchange devices being stacked in a parallel configuration with one or more manifolds connecting the pressure exchange device and the additional pressure exchange devices.

12. A system for exchanging pressure between at least two fluid streams, the system comprising:

a pressure exchange device comprising:

a high pressure inlet for receiving a fluid at a first higher pressure;

at least two low pressure inlets for receiving a downhole fluid at a first lower pressure;

at least two high pressure outlets for outputting the downhole fluid at a second higher pressure that is greater than the first lower pressure;

at least two low pressure outlets for outputting the fluid at a second lower pressure that is less than the first higher pressure;

at least two chambers positioned in a parallel configuration, the at least two chambers in fluid communication with the at least two low pressure inlets and the at least two high pressure outlets;

a valve device comprising a linear valve actuator, the valve device configured to:

selectively place the fluid at the first higher pressure in communication with the downhole fluid at the first lower pressure in the at least two chambers in order to pressurize the downhole fluid to the second higher pressure; and selectively output the fluid at the second lower pressure from the pressure exchange device from the at least two chambers through one of the at least two low pressure outlets;

at least one pump for supplying the fluid at the first higher pressure to the high pressure inlet of the pressure device; and additional pressure exchange devices each including at least two additional chambers positioned in a parallel configuration, each of the at least two chambers positioned in the parallel configuration of the pressure exchange device and the at least two additional chambers positioned in the parallel configuration of the additional pressure exchange devices being stacked in a parallel configuration with one or more manifolds connecting the at least two chambers of the pressure exchange device and the at least two additional chambers of the additional pressure exchange devices.

13. The system of claim 12, further comprising additional pressure exchange devices, the pressure exchange device and the additional pressure exchange devices being stacking in a parallel configuration with one or more manifolds connecting the pressure exchange device and the additional pressure exchange devices.

14. A device for exchanging pressure between at least two fluid streams, the device comprising:

at least one high pressure inlet for receiving a fluid at a first higher pressure;

at least one low pressure inlet for receiving a downhole fluid at a first lower pressure;

at least one high pressure outlet for outputting the downhole fluid at a second higher pressure that is greater than the first lower pressure;

at least one low pressure outlet for outputting the fluid at a second lower pressure that is less than the first higher pressure;

a valve device configured to:

selectively place the fluid at the first higher pressure in communication with the downhole fluid at the first lower pressure in order to pressurize the downhole fluid to the second higher pressure; and selectively output the fluid at the second lower pressure from the device through the at least one low pressure outlet; and at least one tank including a piston for separating fluid in the at least one tank, the at least one tank in communication with the at least one high pressure outlet, the at least one low pressure inlet, the at least one high pressure inlet, and the at least one low pressure outlet, wherein the at least one high pressure outlet and the at least one low pressure inlet are positioned on a first end of the at least one tank, wherein the valve device is coupled to the at least one tank at a second end of the at least one tank, and wherein the at least one high pressure inlet and the at least one low pressure outlet are positioned on the valve device;

a control device on the at least one tank, wherein the valve device is configured to alter a position of one or more valve members in the valve device in response to the control device detecting a position of the piston in the at least one tank; and wherein the valve device is configured to move at variable rates in order selectively fill and empty at least one tank in communication with the at least one low pressure outlet and the at least one high pressure inlet.

15. The device of claim 14, wherein the valve device is configured to:

move at a first higher rate of speed when in communication with the at least one low pressure outlets; and move at a second lower rate of speed that is less than the first higher rate of speed when transitioning between being in communication with the at least one low pressure outlet and being in communication with the at least one high pressure inlet.

16. A method of exchanging pressure between at least two fluid streams, the method comprising:

receiving a fluid at a first higher pressure into a pressure exchanger from a high pressure inlet;

receiving a downhole fluid at a first lower pressure into the pressure exchanger from a first low pressure inlet;

placing the fluid at the first higher pressure in communication with the downhole fluid at the first lower pressure in order to pressurize the downhole fluid to a second higher pressure that is greater than the first lower pressure;

outputting the downhole fluid at the second higher pressure;

receiving additional fluid at the first higher pressure into the pressure exchanger from the high pressure inlet;

receiving additional downhole fluid into the pressure exchanger from a second low pressure inlet; and regulating flow of the additional fluid by moving a valve actuator of a valve device at more than one speed, comprising:

moving the valve actuator at a first higher rate of speed when in communication with a low pressure outlet; and moving the valve actuator at a second lower rate of speed that is less than the first higher rate of speed when transitioning into communication with the high pressure inlet.

17. The method of claim 16, further comprising:

placing the additional fluid in communication with the additional downhole fluid in order to pressurize the additional downhole fluid to substantially the second higher pressure; and outputting the additional downhole fluid through a high pressure outlet that is separate from another high pressure outlet utilized to output the downhole fluid.

18. The method of claim 16, further comprising monitoring a position of a movable piston for separating fluid in at least one tank of the pressure exchanger.

19. The method of claim 18, further comprising altering a position of one or more valve members in the valve device with the valve actuator in response to a control device detecting a position of the piston in the at least one tank.

20. The method of claim 16, further comprising:

after pressuring at least one of the downhole fluid or the additional downhole fluid, outputting a resulting low pressure fluid through at least one of two low pressure fluid outputs;

directing the resulting low pressure fluid from both of the two low pressure fluid outputs to a blender; and after directing the resulting low pressure fluid to the blender, directing the resulting low pressure fluid back into the pressure exchanger as another downhole fluid at substantially the first lower pressure.

* * * * *